US012735159B1

(12) United States Patent
Du et al.

(10) Patent No.: US 12,735,159 B1
(45) Date of Patent: Sep. 15, 2026

(54) MARINE PROPELLER WITH WINGLETS AND METHOD OF DESIGN THEREOF

(71) Applicant: Brunswick Corporation, Mettawa, IL (US)

(72) Inventors: Weikang Du, Jackson, WI (US); Andrew C. Gunderson, Fond du Lac, WI (US); Jeffrey D. Reifsnyder, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 442 days.

(21) Appl. No.: 18/446,548

(22) Filed: Aug. 9, 2023

Related U.S. Application Data

(60) Provisional application No. 63/397,152, filed on Aug. 11, 2022.

(51) Int. Cl.
*B63H 1/26* (2006.01)
*B63H 1/18* (2006.01)

(52) U.S. Cl.
CPC ..... *B63H 1/26* (2013.01); *B63H 1/18* (2013.01)

(58) Field of Classification Search
CPC ..... B63H 1/18; B63H 1/26
See application file for complete search history.

(56) References Cited

U.S. PATENT DOCUMENTS 7,393,181 B2 * 7/2008 McBride ..... F04D 29/526 416/240
7,637,722 B1 * 12/2009 Koepsel ..... B63H 1/14 416/241 R (Continued)

FOREIGN PATENT DOCUMENTS

CN 101278127 A * 10/2008 ..... A61M 60/414
CN 111664052 A * 9/2020 ..... F03D 1/0633

(Continued)

OTHER PUBLICATIONS

Du, Weikang et al., "Optimization Design and Analysis of Highly Loaded Conventional and Winglet Propellers," paper presented during Seventh International Symposium on Marine Propulsors, Oct. 2022, Wuxi, China.

(Continued)

*Primary Examiner* — Marc Q Jimenez
*Assistant Examiner* — Jovon E Hayes
(74) *Attorney, Agent, or Firm* — Andrus Intellectual Property Law, LLP

(57) ABSTRACT

A propeller for a marine propulsion device comprises a hub extending along an x-axis and a plurality of blades, each having a blade root attached to the hub and extending radially outwardly from the x-axis toward a respective blade tip. Each blade comprises a y-axis extending radially outwardly from and perpendicular with respect to the x-axis. Each blade also comprises a z-axis extending perpendicularly to both the x- and y-axes. Each blade comprises a winglet with a plurality of winglet sections proximate its blade tip, the winglet sections beginning at a given radial location on the blade and ending at the blade tip. Each winglet section on each blade is rotated about the blade's z-axis such that the blade tip is offset between about 1 degree and about 90 degrees from a surface of the blade that is radially inwardly of and adjacent to the given radial location.

13 Claims, 5 Drawing Sheets

(56) References Cited

U.S. PATENT DOCUMENTS

| | | | | |
|---|---|---|---|---|
| 8,814,496 | B2 * | 8/2014 | Lehmann | B63H 1/28 415/142 |
| 9,021,970 | B2 * | 5/2015 | Kawakita | B63H 1/26 440/49 |
| 9,404,505 | B2 * | 8/2016 | Scheckel | A61M 60/13 |
| 9,745,948 | B1 * | 8/2017 | Koepsel | B63H 1/26 |
| 11,273,892 | B2 * | 3/2022 | Sharrow | F03D 1/0625 |
| 12,030,605 | B1 * | 7/2024 | Stampick | B63H 3/002 |

FOREIGN PATENT DOCUMENTS

| | | | | |
|---|---|---|---|---|
| EP | 4039577 | A1 * | 8/2022 | B63H 1/24 |
| WO | WO-2020212664 | A1 * | 10/2020 | B63B 32/60 |

OTHER PUBLICATIONS

DT Propeller, "Winglets: what are they and what are they used for?" web article, Mar. 22, 2020, available at https://dtpropeller.com/2020/03/22/winglets-what-are-they-and-what-are-they-used-for/, last accessed Aug. 9, 2023.

* cited by examiner

FIG. 1
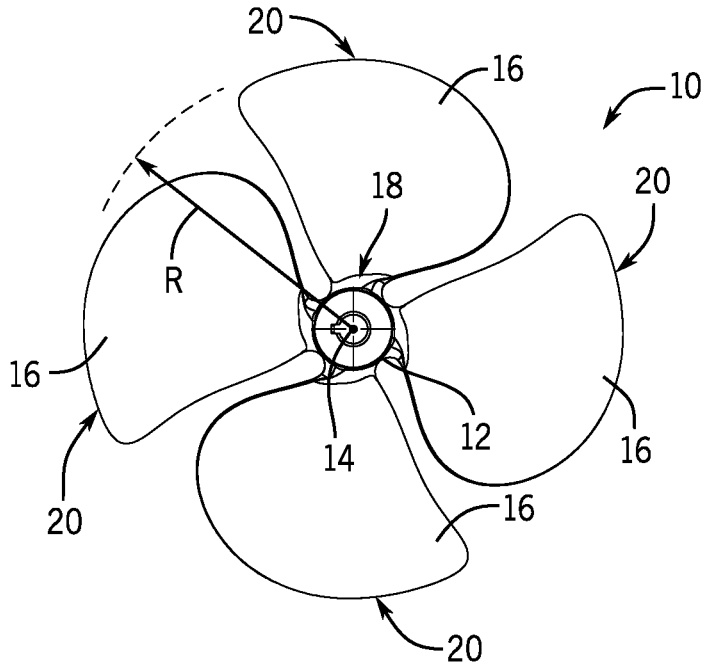
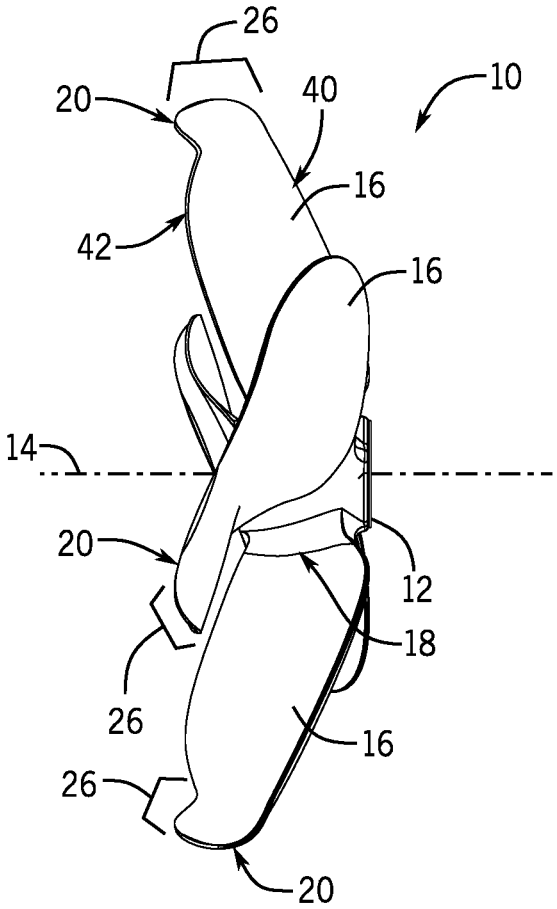
FIG. 2

MARINE PROPELLER WITH WINGLETS AND METHOD OF DESIGN THEREOF

CROSS-REFERENCE TO RELATED APPLICATION

This application claims the benefit of U.S. Provisional Application No. 63/397,152, filed Aug. 11, 2022, which is hereby incorporated by reference herein in its entirety.

FIELD

The present disclosure relates to marine propellers for use on marine propulsion devices. More specifically, the present disclosure relates to the geometry of the blades of such propellers as well as method for designing the geometry of the blades.

BACKGROUND

U.S. Pat. No. 7,637,722, which is hereby incorporated by reference herein, discloses a marine propeller provided with three blades, a skew angle of approximately 33 degrees, a rake angle of approximately 28.5 degrees, and a blade area ratio (BAR) of approximately 60 degrees. The rake is preferably progressive. Each of the blades is preferably tail loaded.

U.S. Pat. No. 8,814,496 discloses a device for reducing the drive power requirement of a watercraft includes a fore-nozzle, wherein at least one outer fin projects outwards from the fore-nozzle.

U.S. Pat. No. 9,021,970 discloses a propulsion device of a ship including a port side screw propeller; and a starboard side screw propeller provided in a forward or backward direction in a longitudinal direction of the ship from the port side screw propeller, such that a part of propeller wings of the starboard side screw propeller overlaps with propeller wings of the port side screw propeller. One of the port side screw propeller and the starboard side screw propeller, which is on a forward side in a longitudinal direction of the ship, is the forward screw propeller, and the other is the backward screw propeller. The forward screw propeller has a wing shape by which tip vortex cavitation is more difficult to be generated by the forward screw propeller than the backward screw propeller.

U.S. Pat. No. 9,745,948, which is hereby incorporated by reference herein, discloses a marine propeller having an outer hub having a central axis and a blade having a blade root attached to the outer hub and extending radially outward from the outer hub toward a blade tip. The blade has a leading edge and a trailing edge. The propeller has a diameter between about 15 inches and about 17 inches and a pitch between about 14 inches and about 24 inches. The blade has a progressive rake angle such that a first local rake angle at the blade root is less than a second local rake angle at the blade tip. A combination of the diameter, pitch, and progressive rake angle provides a marine vessel to which the marine propeller is coupled with minimum drag while the marine vessel is operating at less than a maximum vessel speed. A method of designing a propeller is also disclosed.

U.S. Pat. No. 11,273,892 discloses a propeller having a means for creating fluid flow in a non-axial direction and redirecting it in an axial direction.

International Application Publication WO 2020/212664 discloses an electrically driven rotating device comprising a stator with a cylindrical shape, comprising at least one coil and a rotor in the form of a hollow cylinder comprising at least one magnet. The stator and rotor are substantially coaxial, the rotor being rotatably mounted relative to the stator. In order to improve the reliability of the electrically driven rotating device by simplifying the structure thereof, whilst reducing the weight and overall dimensions, the electrically driven rotating device comprises at least one mechanical bearing fixedly mounted about a portion of the stator. The electrically driven rotating device can be mounted in a drive system and the drive system in an electrically driven watercraft.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a propeller for a marine propulsion device comprises a hub extending along an x-axis and a plurality of blades, each blade in the plurality of blades having a blade root attached to the hub and extending radially outwardly from the x-axis toward a respective blade tip. Each blade in the plurality of blades comprises a y-axis extending radially outwardly from and perpendicular with respect to the x-axis. Each blade in the plurality of blades also comprises a z-axis extending perpendicularly to both the x- and y-axes. Each blade in the plurality of blades comprises a plurality of winglet sections proximate its blade tip, the plurality of winglet sections beginning at a given radial location on the blade and ending at the blade tip. Each winglet section in the plurality of winglet sections on each blade is rotated about the blade's z-axis such that the blade tip is offset between about 1 degree and about 90 degrees from a surface of the blade that is radially inwardly of and adjacent to the given radial location.

According to one aspect, the blade tip of each blade is rotated about the blade's z-axis by between about 1 degree and about 15 degrees. According to one aspect, the blade tip of each blade is rotated about the blade's z-axis by between about 1 degree and about 10 degrees. According to one aspect, the blade tip of each blade is rotated about the blade's z-axis by between about 1 degree and about 5 degrees.

According to one aspect, the blade tip is offset between about 1 degree and about 70 degrees from the surface of the blade that is radially inwardly of and adjacent to the given radial location. According to one aspect, the blade tip is offset between about 1 degree and about 50 degrees from the surface of the blade that is radially inwardly of and adjacent to the given radial location. According to one aspect, the blade tip is offset between about 1 degree and about 30 degrees from the surface of the blade that is radially inwardly of and adjacent to the given radial location.

According to one aspect, the given radial location on each blade is between about 80% to about 99% of a radius of the propeller. According to one aspect, the given radial location on each blade is between about 85% to about 99% of the radius of the propeller. According to one aspect, the given radial location on each blade is between about 90% to about 99% of the radius of the propeller.

According to one aspect, the blade tip is offset toward a pressure side of the blade.

According to one aspect, the blade tip is offset toward a suction side of the blade.

According to another example of the present disclosure, a propeller for a marine propulsion device comprises a hub extending along an x-axis and a plurality of blades, each blade in the plurality of blades having a blade root attached to the hub and extending radially outwardly from the x-axis toward a respective blade tip. Each blade in the plurality of blades comprises a y-axis extending radially outwardly from and perpendicular with respect to the x-axis. Each blade in the plurality of blades also comprises a z-axis extending perpendicularly to both the x- and y-axes. Each blade in the plurality of blades comprises a plurality of winglet sections proximate its blade tip that is rotated about the blade's z-axis. The blade tip of each blade in the plurality of blades is rotated about the blade's z-axis by between about 1 degree and about 15 degrees.

According to one aspect, the blade tip of each blade in the plurality of blades is rotated about the blade's z-axis by between about 1 degree and about 10 degrees. According to one aspect, the blade tip of each blade in the plurality of blades is rotated about the blade's z-axis by between about 1 degree and about 5 degrees.

According to one aspect, the plurality of winglet sections on each blade begins at a given radial location on the blade and ends at the blade tip, and the blade tip on each blade is offset between about 1 degree and about 90 degrees from a surface of the blade that is radially inwardly of and adjacent to the given radial location. According to one aspect, the blade tip is offset between about 1 degree and about 70 degrees from the surface of the blade that is radially inwardly of and adjacent to the given radial location. According to one aspect, the blade tip is offset between about 1 degree and about 50 degrees from the surface of the blade that is radially inwardly of and adjacent to the given radial location. According to one aspect, the blade tip is offset between about 1 degree and about 30 degrees from the surface of the blade that is radially inwardly of and adjacent to the given radial location.

According to one aspect, the plurality of winglet sections on each blade begins at a given radial location on the blade and ends at the blade tip, and the given radial location is between about 80% to about 99% of a radius of the propeller. According to one aspect, the given radial location is between about 85% to about 99% of the radius of the propeller. According to one aspect, the given radial location is between about 90% to about 99% of the radius of the propeller.

According to one aspect, the blade tip is rotated toward a pressure side of the blade.

According to one aspect, the blade tip is rotated toward a suction side of the blade.

BRIEF DESCRIPTION OF THE DRAWINGS

The present disclosure is described with reference to the following Figures. The same numbers are used throughout the Figures to reference like features and like components.

FIG. 1 illustrates a view of one example of a propeller according to the present disclosure, viewed from the pressure side thereof.

FIG. 2 illustrates a side view of the propeller of FIG. 1.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings. Unless otherwise specified or limited, the term "about" means±10%.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

Figure 3:
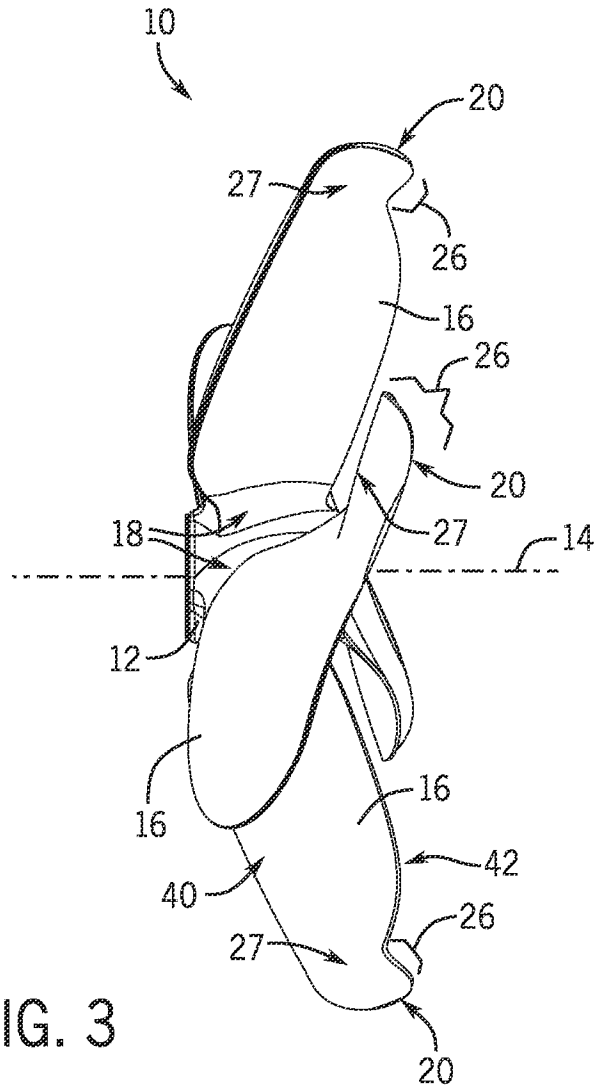
FIG. 3 illustrates an opposite side view of the propeller of FIG. 1.

FIG. 1 illustrates a propeller 10 for a marine propulsion device (such as, but not limited to, an outboard drive, a stern drive, an inboard drive, or a pod drive) according to the present disclosure. The propeller 10 comprises a hub 12 extending along an x-axis 14, which is the longitudinal axis of the propeller 10 about which the hub 12 rotates when input torque is provided via a propeller shaft. The propeller shown in FIGS. 1-6 is designed to rotate counterclockwise about the x-axis when viewed from behind the propeller, commonly referred to as the left-hand direction. The propeller could instead be designed to rotate clockwise about the x-axis when viewed from behind the propeller, commonly referred to as the right-hand direction. Those having ordinary skill in the art would understand how to apply the principles of design of the left-hand propeller shown and described herein to a right-hand propeller. The propeller 10 also has a plurality of blades 16. In the present example, the propeller 10 has four blades, but the propeller could have another number of blades, such as three, five, or more. Each blade 16 has a blade root 18 attached to the hub 12 and extends radially outwardly from the x-axis 14 toward a respective blade tip 20. FIG. 1 shows the propeller 10 from a pressure side of the blades 16. FIG. 2 shows the propeller 10 from the starboard side, while FIG. 3 shows the propeller 10 from the port side (assuming the propeller 10 is installed as part of a conventional inboard drive on a boat 34; see, for example, FIG. 7).

Figure 4:
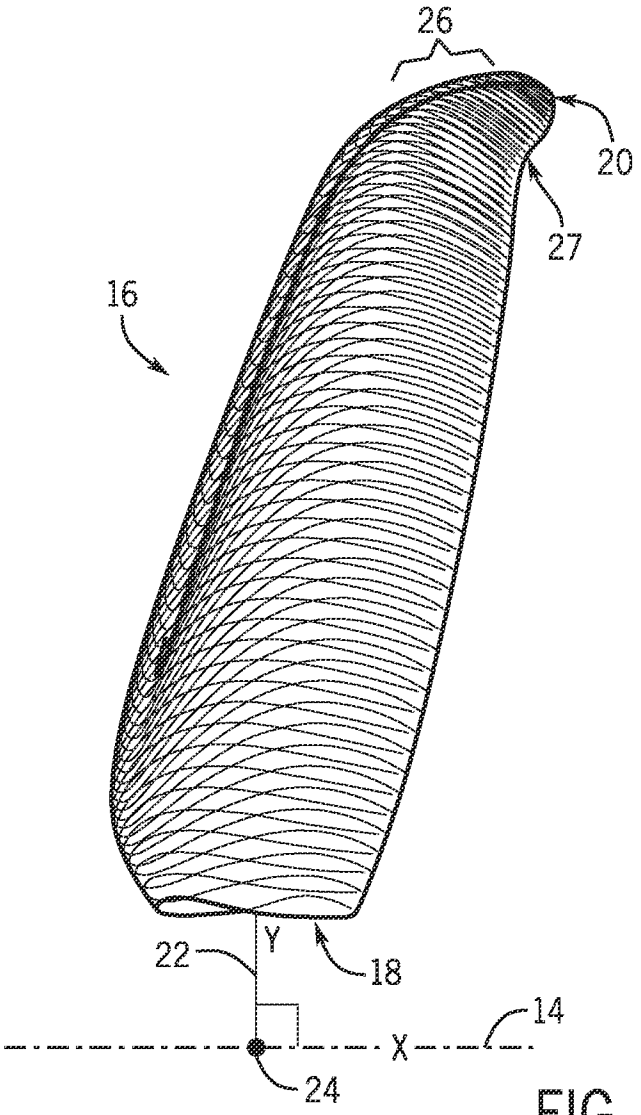
FIG. 4 shows a propeller blade in isolation, along with a local coordinate system for defining the geometry of the propeller.

Referring to FIG. 4, in which one blade 16 of the propeller 10 is shown in isolation, each blade 16 comprises a local y-axis 22 extending radially outwardly from and perpendicular with respect to the x-axis 14. That is, for a four-blade propeller, there are four local y-axes: one at 0 degrees for a first blade, one at 90 degrees for a second blade, one at 180 degrees for a third blade, and one at 270 degrees for a fourth blade. Each y-axis 22 points from the mid-chord of the root section 18 toward the blade tip 20 as if the propeller blade 16 has zero rake, zero skew, and no winglet (i.e., the geometry before winglet sections, described herein below, are rotated). Each blade 16 also comprises a local z-axis 24 extending perpendicularly to both the x- and y-axes 14, 22. That is, for a four-blade propeller, there are four local z-axes, each of which is perpendicular to the global x-axis 14 and to its respective local y-axis 22. Thus, the global x-axis 14, a local y-axis 22, and a local z-axis 24 form a right-hand Cartesian coordinate system for each blade 16.

Figure 5:
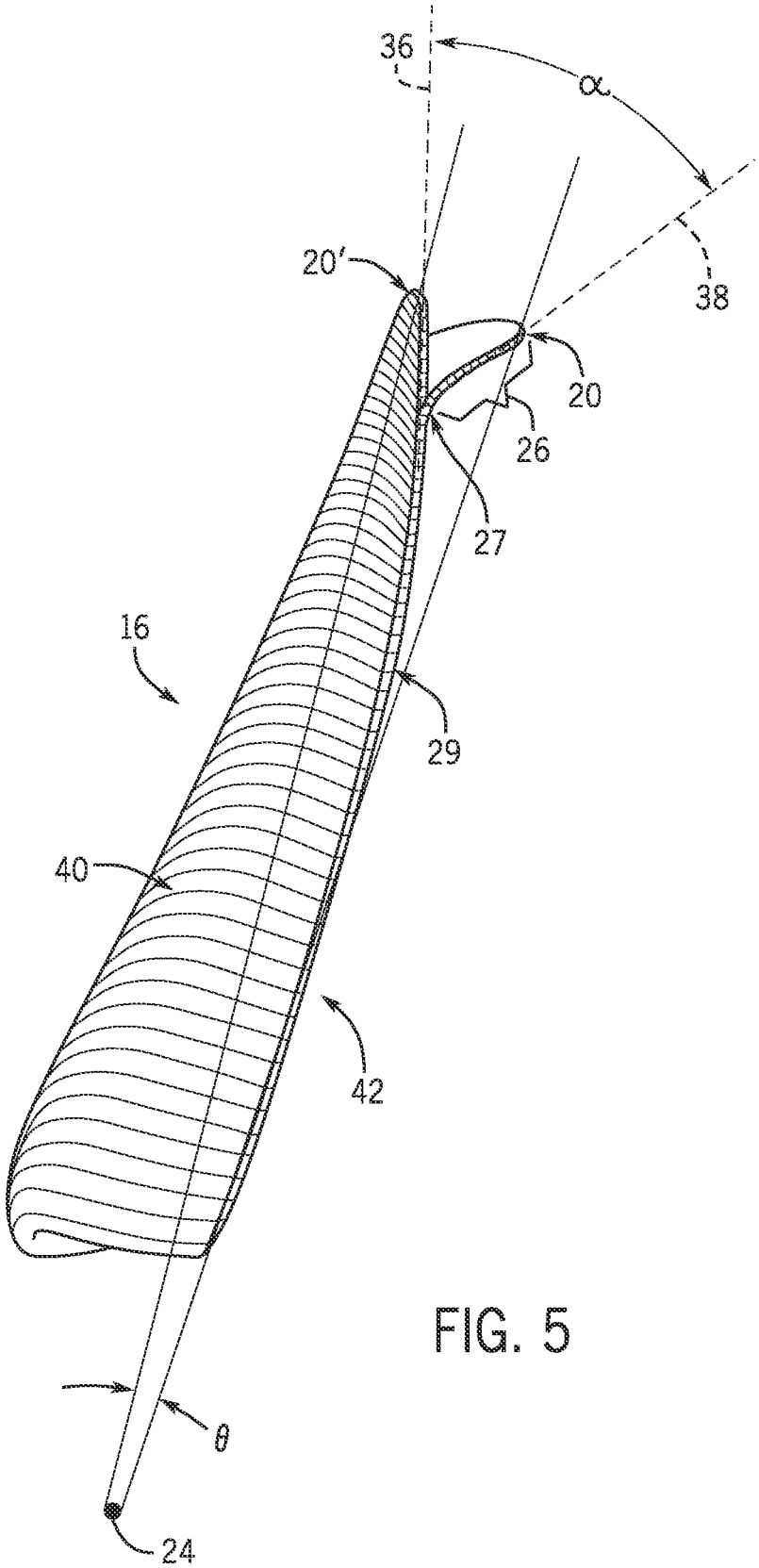
FIG. 5 shows a propeller blade in isolation and is used to explain the geometry of a winglet of the blade.

As can be seen in FIGS. 1-5, each blade 16 comprises a plurality of winglet sections 26 proximate its blade tip 20. Referring specifically to FIGS. 4 and 5, a blade section is a cross-sectional slice of the propeller blade 16, as shown by the curved lines spaced from one another along the span of the propeller blade, each of which delineates a given blade section. The winglet sections 26 are the blade sections proximate a given blade's tip 20 that together make up a winglet on that propeller blade 16. Propellers with winglets are sometimes also referred to as "tip-loaded" propellers or "tip-fin" propellers. Two parameters are used to parameterize the plurality of winglet sections 26 of the propeller 10: (1) the radial location where the blade section begins to bend or rotate, and (2) the angle by which the blade section closest to the blade tip 20 rotates about the blade's local z-axis 24. The former is referred to herein as the "given radial location" and the latter as the "tip angle," where the given radial location is non-dimensionalized by the blade radius and the unit of tip angle is degrees. The given radial location, shown at 27 in FIGS. 1-5, is the non-dimensionalized radius at which the blade begins to rotate or bend away from a base blade geometry. A base blade geometry is a geometry defined by distributions of at least the following parameters as a function of radius: thickness, rake, skew, pitch, maximum camber, and mean camber. As referred to herein, a blade having "conventional geometry" is a blade with a base blade geometry and a tip angle of zero (i.e., having no winglet sections) and a "conventional propeller" is a propeller with propeller blades having conventional geometry.

As shown in FIG. 5, the plurality of winglet sections 26 on the blades 16 of the propeller 10 are generated by rotating each tip section (the blade section at the very tip 20) of a conventional propeller around the blade's respective z-axis 24 by a tip angle θ. According to one example of the present disclosure, the winglet section at the tip 20 of each blade 16 is rotated about the blade's local z-axis 24 by an angle θ that is between about 1 degree and about 15 degrees. However, in another example the winglet section at the tip 20 of each blade 16 is rotated about the blade's local z-axis 24 by an angle θ that is between about 1 degree and about 10 degrees. In still another example, the winglet section at the tip 20 of each blade 16 is rotated about the blade's local z-axis 24 by an angle θ that is between about 1 degree and about 5 degrees.

To ensure that the propeller geometry has a smooth transition between the plurality of winglet sections 26 and the rest of the blade 16, a polynomial function is used for the rotating angles of each winglet section in the plurality of winglet sections 26, where at the given radial location 27 (see FIGS. 3-5) where the plurality of winglet sections 26 begins, both the rotating angle of the blade section and the slope of the distribution of the rotating angles are zero, and the rotating angle gradually increases to the selected maximum tip angle θ about the z-axis 24 at the blade tip 20. In one example, between the given radial location 27 where the plurality of winglet sections 26 begins and the blade tip 20, the rotation of the plurality of winglet sections 26 about the z-axis 24 is defined by a polynomial function. However, any function that has a zero value and zero derivative can be used to calculate the rotating angles of each winglet section, such as cosine functions.

Rotating the plurality of winglet sections 26 of each blade 16 about the blade's respective z-axis 24 (with the maximum rotation angle being the tip angle θ at the blade tip 20) results in the plurality of winglet sections 26 being offset (angled) with respect to a surface of the blade 16 that is radially inwardly of and adjacent to the given radial location 27 where the plurality of winglet sections 26 begins. In the present disclosure, the angle at which the plurality of winglet sections 26 is oriented with respect to the surface of the blade 16 that is radially inwardly of and adjacent to the given radial location 27 at which the plurality of winglet sections 26 begins is shown and referred to as α.

FIG. 5 shows how the plurality of winglet sections 26 is offset (angled) by the angle α from the surface of the blade 16 that is radially inwardly of and adjacent to the given radial location 27 where the plurality of winglet sections 26 begins to bend or rotate from the conventional geometry, with the tip of a blade having conventional geometry being shown at 20'. The angle α is defined by a best fit line 36 for the blade's surface just radially inwardly of the given radial location 27 where the plurality of winglet sections 26 begins, and a best fit line 38 for the surface of the plurality of winglet sections 26. In one example, a is between about 1 degree and about 90 degrees. In another example, α is between about 1 degree and about 70 degrees. In still another example, a is between about 1 degree and about 50 degrees. In still another example, a is between about 1 degree and about 30 degrees. The surface of the blade used to define the best fit lines 36, 38 can be the pressure side surface 42, the suction side surface 40, or the end/cross-sectional surface, as long as the same surface is used to define each best fit line in a given example. Here, the end surface of the blade is used to define the best fit lines 36, 38.

It should be understood that larger values for the tip angle θ (about which the blade tip 20 is rotated with respect to the z-axis 24) will also result in larger angles of α (at which the plurality of winglet sections 26 is offset from the surface of the blade that is radially inwardly of and adjacent to the given radial location 27 where the plurality of winglet sections 26 begins), and vice versa. The present disclosure is intended to cover both methods or algorithms for defining the geometry of the plurality of winglet sections 26.

In one example, the plurality of winglet sections 26 on each blade 16 begins to bend or rotate from the conventional geometry (i.e., the propeller blade without a winglet) at a given radial location 27 that is between about 80% to about 99% of a radius (see R, FIG. 1) of the propeller 10. The radius R is the non-dimensionalized distance between the global X-axis 14 and the tips 20 of the blades 16. In another example, the plurality of winglet sections 26 on each blade 16 begins at a given radial location 27 that is between about 85% to about 99% of a radius R of the propeller 10. In yet another example, the plurality of winglet sections 26 on each blade 16 begins at a given radial location 27 that is between about 90% to about 99% of a radius R of the propeller 10.

As in the example shown in FIG. 5, the best fit line 36 may not define the surface of the blade 16 at every radial location due to the distributions of parameters defining the base blade geometry. For example, the surface of the blade 16 at radial location 29 is not defined by the best fit line 36. Thus, the surface of the blade 16 to which the plurality of winglet sections 26 is compared for purposes of defining the angle α, which blade surface is considered to be adjacent to the given radial location 27, may be the blade surface that extends radially inwardly from the given radial location 27 by about 5% to about 10% of the radius R. By way of non-limiting example, if the given radial location 27 is 90% of the radius R, the surface of the blade used to define the best fit line 36 may be the surface that extends from 85% of the radius R to 90% of the radius R. By way of further non-limiting example, if the given radial location 27 is 90% of the radius R, the surface of the blade used to define the best fit line 36 may be the surface that extends from 80% of the radius R to 90% of the radius R.

Figure 6:
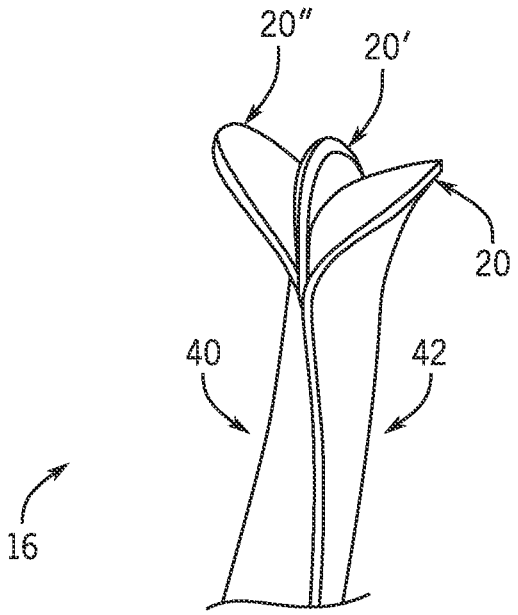
FIG. 6 shows a tip end of a propeller blade and how the winglet may bend to the pressure side or the suction side of the propeller blade.
Figure 7:
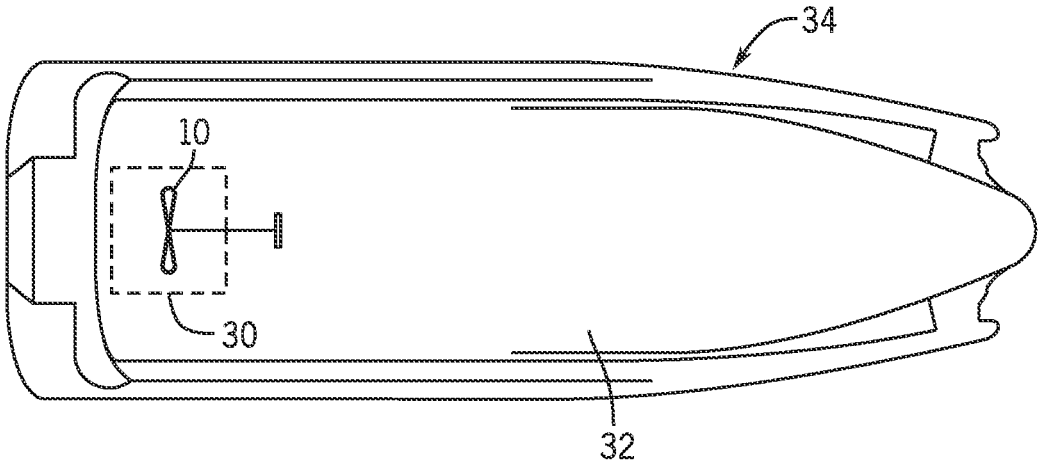
FIG. 7 shows a bottom view of a marine vessel used to model performance of the propeller of the present disclosure.

There are three possible cases for tip angle θ, as shown in FIG. 6: (a) the tip angle is positive when the tip bends toward the suction side 40 of the blade 16, as shown by the tip 20", making the winglets similar to those used in airplane wings, (ii) the tip angle is negative when the tip bends toward the pressure side 42 of the blade 16, as shown by the tip 20, and (iii) the tip angle is zero or close to zero, as in a conventional propeller, as shown by the tip 20'. In the example depicted in FIGS. 1-5, the blade tip 20 is offset toward the pressure side 42 of the blade 16; however, the blade tip could be offset toward the suction side 40 of the blade in other examples.

In one specific example, in which the propeller 10 is designed for a surf boat operating under surfing conditions, the plurality of winglet sections 26 on each blade 16 begins at a location that is between about 90% to about 99% of a radius of the propeller 10 and each winglet section in the plurality of winglet sections 26 on each blade 16 is rotated between about 1 degree and about 6 degrees about the blade's local z-axis 24 toward the pressure side 42 of the blade 16. A surf boat is also known as a "wake boat" or a "ski boat" and typically has an inboard power system, a relatively narrow beam, and a relatively low deadrise and may be equipped with ballast tanks and/or trim tabs for wake shaping. Typically, surfing conditions require that the boat is at a cruising speed, which is typically below maximum speed, and obtained in the 3000 to 5000 RPM range of the engine or motor coupled to the propeller.

The present disclosure also includes a method for designing a propeller 10 for use on a boat 34, the method including selecting a given propeller rotational speed, a given speed of the boat, and a given target power. In one non-limiting example, the propeller speed is 2000 RPM, the boat speed is 12 mph, and the target engine power is 135 hp. In one example, the design objective is to maximize the propeller thrust for the given target power. For example, the optimization objective for the propeller is to maximize the propeller thrust at a given inflow velocity and propeller rotational speed, which remain fixed for all propeller designs evaluated. The method may include selecting a base geometry for the blades of the propeller, including a base thickness profile, a base rake distribution, and a base skew distribution. For example, the base geometry for the propellers uses the National Advisory Committee for Aeronautics (NACA) a=0.8 mean line camber profile and a modified NACA 66 thickness profile. The maximum thickness distributions are determined using preliminary finite element analysis (FEA) simulations. In one example, the maximum thickness, rake, and skew distributions in the base geometry do not change during the optimization process. (In other examples, the thickness profile, rake distribution, and skew distribution may vary.) Next, the method includes iteratively varying a set of parameters (including, but not limited to: pitch, camber distributions, and the winglet shapes) further defining the geometry of the blades and calculating efficiencies of propellers having blades defined by the base geometry and the set of parameters. The design objective is to achieve the highest thrust coefficient KT with given torque coefficient KQ. The propeller efficiency η is calculated by the following equation:

$$\eta = \frac{KT}{KQ}\frac{J}{2\pi} \text{ where} \quad \text{Eq. 1}$$

$$KT = \frac{T}{\rho n^2 D^4} \text{ where} \quad \text{Eq. 2}$$

$$KT = \frac{Q}{\rho n^2 D^5} \text{ where} \quad \text{Eq. 3}$$

$$J = \frac{V_s}{nD} \quad \text{Eq. 4}$$

and where $V_s$ is the boat speed, Tis the propeller thrust, Q is the torque on the propeller, ρ is the density of the water, D is the propeller diameter, n is the propeller rotational frequency, and J is the advance ratio.

The parameters can be iteratively varied with steady Reynolds-Averaged Navier-Stokes (RANS) simulations using a Simultaneous Hybrid Exploration that is Robust, Progressive, and Adaptive (SHERPA) algorithm in the commercial software STAR-CCM+ (Siemens Digital Industries Software, 2022). The optimization process includes modifying parameters such as the start of the winglet's location, maximum rotation about the z-axis at the tip, and local pitch, camber, diameter, and chord length distribution of the section.

An exemplary non-limiting RANS method will now be discussed. In the RANS method, the velocity field $u_i$ is decomposed into its mean $U_i$ and the fluctuation $u'_i$, as shown in Equation 5:

$$u_i = U_i + u'_i \quad \text{Eq. 5}$$

The governing equations in the RANS method are the continuity equation and the momentum equation, as shown in Equations 6 and 7, respectively:

$$\nabla \cdot \vec{u} = 0 \quad \text{Eq. 6}$$

$$\frac{\partial U_i}{\partial t} + U_j \frac{\partial U_i}{\partial x_j} = -\frac{\partial P}{\partial x_i} + \frac{\partial}{x_j}\left(\nu \frac{\partial U_i}{\partial x_j} - \overline{u'_i u'_j}\right) \quad \text{Eq. 7}$$

where P=the pressure, ν=the kinematic viscosity; and $$\overline{u'_i u'_j}$$

=the Reynolds stress. Two types of simulation are used. The first type is a steady, axisymmetric, single blade simulation with periodic boundary conditions used during the initial optimization phase. The performance of a few thousand winglet propellers designs are evaluated under the open water condition using the SHERPA algorithm, after which a number of high performing designs are selected. The second type is an unsteady RANS simulation in the analysis phase with mesh motion used to simulate the propeller rotation underneath a hull with an inclined shaft angle. The unsteady RANS simulations are used to evaluate the selected conventional propeller designs from the non-linear optimization solver CAVOPT-3D and the selected winglet propeller designs from the SHERPA algorithm. Both steady and unsteady RANS simulations use the Volume of Fluid (VOF) Eulerian Multiphase model, Schnerr-Sauer cavitation model, Realizable KEpsilon turbulence model, and the All-Y+ Wall Function model (Siemens Digital Industries Software, 2022).

An exemplary non-limiting SHERPA optimization algorithm within RANS will now be described. Simcenter STAR-CCM+ Design Manager (Siemens Digital Industries Software, 2022) may be used to perform the optimization of the winglet propellers. Design Manager is a tool contained in STAR-CCM+ that automates design exploration studies using the search algorithm SHERPA (Simultaneous Hybrid Exploration that is Robust, Progressive, and Adaptive), which chooses the best combination of global and local search methods for a given problem. The optimization objective for the winglet propellers is to maximize the propeller thrust at a given inflow velocity and propeller rotational speed, which remain fixed for all designs evaluated in steady RANS simulations. A constraint is used to ensure that power consumed by the propeller stays close to the design power. The optimization process starts from an initial design with predetermined initial values for the fifteen exemplary parameters listed below:

1. pitch: diameter ratio at hub
2. pitch: diameter ratio at 0.5R
3. pitch: diameter ratio at 0.75R
4. pitch: diameter ratio at given radial location where winglet starts
5. pitch: diameter ratio at R
6. maximum camber: chord length ratio at hub
7. maximum camber: chord length ratio at 0.5R
8. maximum camber: chord length ratio at 0.75R
9. maximum camber: chord length ratio at given radial location where winglet starts
10. maximum camber: chord length ratio at R
11. Ratio of winglet propeller reference diameter to diameter of base geometry
12. First parameter to control chord length distribution
13. Second parameter to control chord length distribution
14. Given radial location where winglet starts
15. Tip angle θ

A range and an increment are defined for each of the fifteen parameters. The ranges are based on engineering judgement and space constraints for the propeller geometry. The initial value for tip angle θ is zero, meaning that the optimization for winglet propellers starts from a conventional propeller. The range for tip angle θ is from −10 degrees to 10 degrees, allowing the winglet sections to bend to both the pressure side and suction side of the base geometry by a large range when generating winglets.

A subset of the winglet propellers defined by the base geometry and the varied set of parameters is selected, these being the propellers that have the greatest efficiency calculated according to Equation 1 above. The camber and pitch at the blade tips of the selected subset of propellers are of a wide range of values, indicating that various combinations of the input parameters can achieve similar efficiency. The method next includes modeling forces induced by each propeller in the subset of propellers to determine an unsteadiness in propeller-induced forces and propeller efficiency for each propeller. For example, the propeller-induced forces in the vertical direction are evaluated by the unsteady RANS method over a patch 30 (FIG. 7) on the bottom of the hull 32 of the boat 34 near the propeller 10. In the unsteady RANS simulations, a few propeller rotational speeds near the input design value may be used to find the propeller rotational speed at which the power absorbed by the propeller 10 equals the given target power. In one non-limiting example, when the target boat speed is 12 mph and the target engine power is 135 hp, the modeled propeller speeds can range from 1500 RPM to 2500 RPM.

Figure 8:
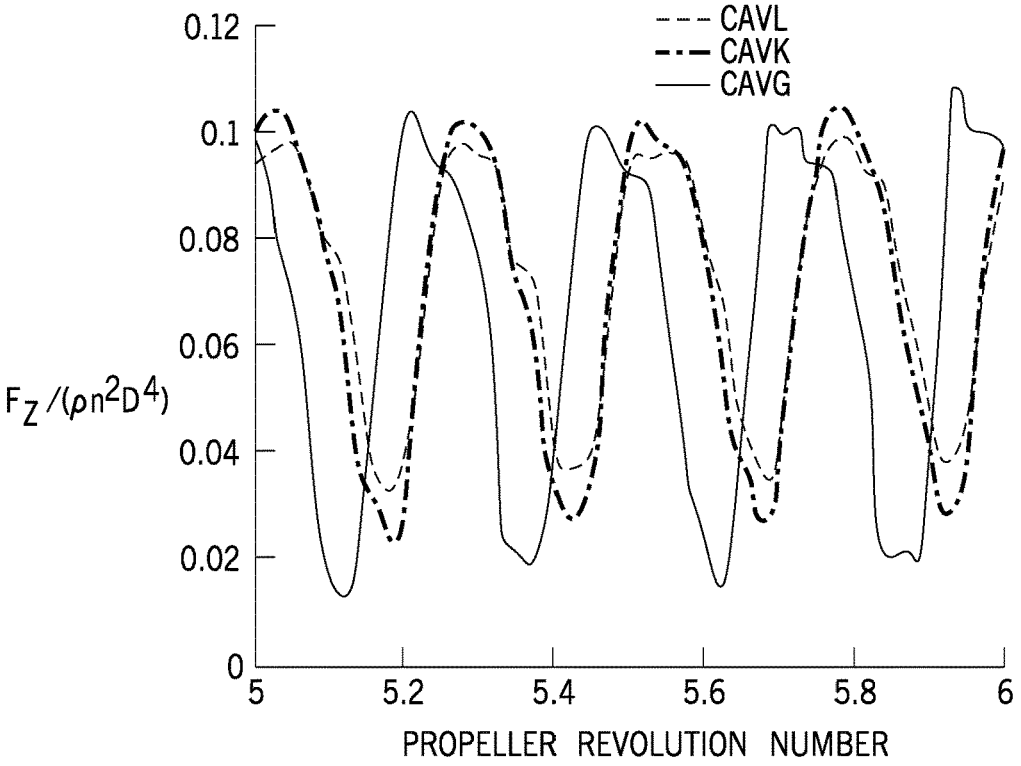
FIGS. 8 and 9 are plots showing performance of several propellers according to the modeling.
Figure 9:
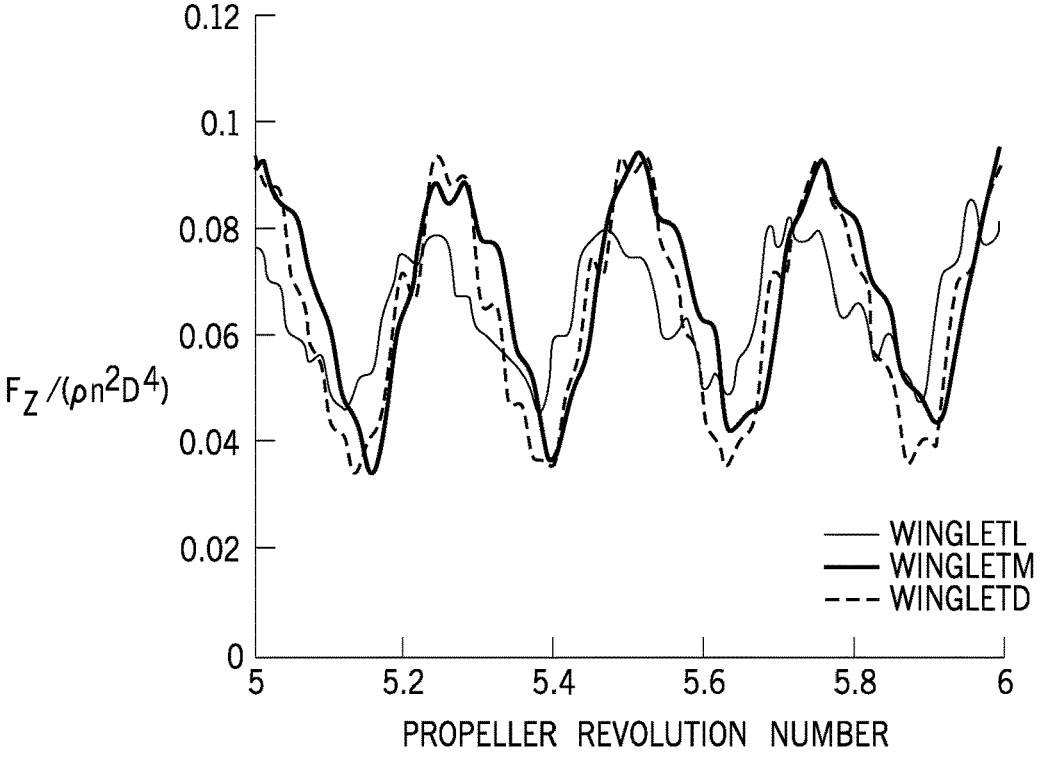

In one example, the unsteadiness in propeller-induced forces can be shown by the difference between the maximum and minimum values over a propeller revolution in unsteady RANS simulation as shown in FIGS. 8 and 9. For the conventional propeller designs (e.g., propellers with no winglet, i.e., blade tip angle is zero or near zero) shown in FIG. 8, propeller CAVG has the largest diameter and the largest unsteadiness in propeller-induced forces. For the winglet propeller designs shown in FIG. 9, the unsteadiness in propeller-induced forces does not correlate with propeller diameter. For example, WINGLETD has the smallest diameter, but the unsteadiness in propeller-induced forces is higher than that in WINGLETL, which has a larger diameter. A possible explanation may be that WINGLETD has higher pressure at the tip than WINGLETL, as determined by studying the pressure contours on each propeller, which may be responsible for the increased unsteadiness in propeller-induced forces. The non-dimensionalized diameters and maximum and minimum unsteadiness in propeller-induced forces for each of the modeled propellers shown in FIGS. 8 and 9 is provided in the table below.

| Design | D/D0 | Min | Max | Diff |
|---|---|---|---|---|
| CAVL | 0.994 | 0.0329 | 0.0990 | 0.0661 |
| CAVK | 1.024 | 0.0227 | 0.1051 | 0.0823 |
| CAVG | 1.058 | 0.0129 | 0.1081 | 0.0952 |
| WINGLETL | 1.007 | 0.0453 | 0.0858 | 0.0406 |
| WINGLETM | 1.045 | 0.0343 | 0.0950 | 0.0607 |
| WINGLETD | 0.992 | 0.0347 | 0.0965 | 0.0617 |

Finally, a propeller having a desired combination of diameter, efficiency, and unsteadiness in propeller-induced forces is selected from the subset of propellers. The objective is to balance designs with high efficiency (i.e., good fuel economy) and relatively small diameter in the subset of optimal propeller designs from the optimization process. Other parameters, such as cavitation and unsteady efficiency of the propeller, may be taken into account during the selection process. As noted hereinabove, the design objective is to achieve the highest efficiency (e.g., as close as possible to the ideal propeller efficiency as given from the actuator disk model of Equation 8, while still working within hull-tip clearance constraints) at a given propeller rotational speed and target power. Through utilizing the above-noted methodology, the present inventors have realized that winglet propellers, such as that shown in FIGS. 1-5, can achieve a higher efficiency, as determined by Equation 1, than conventional propellers with the same overall diameter under a given design condition. (For a winglet propeller, the overall diameter is not the diameter of the base geometry, but the actual diameter of the winglet propeller.) Consequently, winglet propellers are good design choices for highly loaded conditions (e.g., where the advance ratio defined by Equation 4 is equal or smaller than 0.5) with strict constraints on diameter. According to conventional wisdom, the maximum propeller efficiency would generally increase as propeller diameter increases. However, to reduce the noise and vibration to the hull 32 induced by the propeller 10, the maximum propeller diameter is constrained. (Propellers with smaller diameter generally have better noise and vibration characteristics because the clearance between the propeller blade tip 20 and the bottom of the hull 32 will increase with the decrease of propeller diameter.) Thus, winglet propellers show advantages in efficiency over conventional propellers with similar overall diameters and can be good design choices when diameter is limited, for example, to maintain a minimum tip clearance to the hull 32 to constrain the noise from the propeller 10. Further, reduced unsteadiness means that the loading at areas on the hull 32 near the propeller 10 is also reduced, and therefore structure in this area (e.g., the area 30 outlined in FIG. 7) can be reduced.

In some examples, the efficiency (calculated according to Equation 1) of the optimal design of a propeller is 44.9%. Under a high loading condition, the ideal propeller efficiency as given from the actuator disk model (Eq. 8, Kerwin and Hadler, 2010) is 54.3%. An efficiency of 44.9% is higher in efficiency by more than 2% compared with an optimized conventional propeller with a similar diameter.

$$\eta = \frac{2}{1+\sqrt{1+C_T}} \text{ where} \qquad \text{Eq. 8}$$

$$C_T = \frac{T}{\frac{1}{2}\rho\pi R^2 V_s^2} \qquad \text{Eq. 9}$$

As noted, the presently disclosed propeller 10 was designed for a surf boat in surfing conditions. Further designs for a propeller at cruising conditions or wide-open throttle can be modeled, which may result in different values for the offset angle α of the blade tip 20 from the remainder of the blade surface adjacent the location 27 where the plurality of winglet sections 26 begins and/or different values for the maximum rotation angle θ about the z-axis 24 at the blade tip 20 and/or different locations 27 for the beginning of the plurality of winglet sections 26.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims.

What is claimed is:

1. A propeller for a marine propulsion device, the propeller comprising:

a hub extending along an x-axis; and a plurality of blades, each blade in the plurality of blades having a blade root non-pivotably attached to the hub and extending radially outwardly from the x-axis toward a respective blade tip;

wherein each blade in the plurality of blades comprises a y-axis extending radially outwardly from and perpendicular with respect to the x-axis;

wherein each blade in the plurality of blades comprises a z-axis extending perpendicularly to both the x- and y-axes;

wherein each blade in the plurality of blades comprises a plurality of winglet sections proximate its blade tip, the plurality of winglet sections beginning at a given radial location on the blade and ending at the blade tip, wherein the given radial location on each blade is between about 90% to about 99% of a radius of the propeller;

wherein each winglet section in the plurality of winglet sections of each blade is rotated about the blade's z-axis such that the blade tip is offset between about 1 degree and about 90 degrees from a surface of the blade that is radially inwardly of and adjacent to the given radial location; and wherein the blade tip of each blade is rotated about the blade's z-axis by between about 1 degree and about 5 degrees.

2. The propeller of claim 1, wherein the blade tip is offset between about 1 degree and about 70 degrees from the surface of the blade that is radially inwardly of and adjacent to the given radial location.

3. The propeller of claim 2, wherein the blade tip is offset between about 1 degree and about 50 degrees from the surface of the blade that is radially inwardly of and adjacent to the given radial location.

4. The propeller of claim 3, wherein the blade tip is offset between about 1 degree and about 30 degrees from the surface of the blade that is radially inwardly of and adjacent to the given radial location.

5. The propeller of claim 1, wherein the blade tip is offset toward a pressure side of the blade.

6. The propeller of claim 1, wherein the blade tip is offset toward a suction side of the blade.

7. A propeller for a marine propulsion device, the propeller comprising:

a hub extending along an x-axis; and a plurality of blades, each blade in the plurality of blades having a blade root non-pivotably attached to the hub and extending radially outwardly from the x-axis toward a respective blade tip;

wherein each blade in the plurality of blades comprises a y-axis extending radially outwardly from and perpendicular with respect to the x-axis;

wherein each blade in the plurality of blades comprises a z-axis extending perpendicularly to both the x- and y-axes;

wherein each blade in the plurality of blades comprises a plurality of winglet sections proximate its blade tip, each winglet section in the plurality of winglet sections being rotated about the blade's z-axis;

wherein the blade tip of each blade in the plurality of blades is rotated about the blade's z-axis by between about 1 degree and about 5 degrees;

wherein the plurality of winglet sections on each blade begins at a given radial location on the blade and ends at the blade tip; and wherein the given radial location is between about 90% to about 99% of a radius of the propeller.

8. The propeller of claim 7, wherein the blade tip on each blade is offset between about 1 degree and about 90 degrees from a surface of the blade that is radially inwardly of and adjacent to the given radial location.

9. The propeller of claim 8, wherein the blade tip is offset between about 1 degree and about 70 degrees from the surface of the blade that is radially inwardly of and adjacent to the given radial location.

10. The propeller of claim 9, wherein the blade tip is offset between about 1 degree and about 50 degrees from the surface of the blade that is radially inwardly of and adjacent to the given radial location.

11. The propeller of claim 10, wherein the blade tip is offset between about 1 degree and about 30 degrees from the surface of the blade that is radially inwardly of and adjacent to the given radial location.

12. The propeller of claim 7, wherein the blade tip is rotated toward a pressure side of the blade.

13. The propeller of claim 7, wherein the blade tip is rotated toward a suction side of the blade.

* * * * *